US006500053B2

(12) United States Patent
James et al.

(10) Patent No.: US 6,500,053 B2
(45) **Date of Patent: *Dec. 31, 2002**

(54) POLISHING PADS AND METHODS RELATING THERETO

(75) Inventors: David B. James, Newark, DE (US); Lee Melbourne Cook, Steelville, PA (US); Arthur Richard Baker, Wilmington, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/071,668

(22) Filed: Feb. 8, 2002

(65) Prior Publication Data

US 2002/0098782 A1 Jul. 25, 2002

Related U.S. Application Data

(63) Continuation of application No. 09/488,414, filed on Jan. 21, 2000, now Pat. No. 6,354,915.

(60) Provisional application No. 60/116,547, filed on Jan. 21, 1999.

(51) Int. Cl.[7] ..... B24B 1/00

(52) U.S. Cl. ..... 451/41; 451/36; 451/548; 451/527; 51/298

(58) Field of Search ..... 451/41, 548, 527, 451/36, 540, 550, 526, 539; 438/692, 693; 51/298, 307

(56) References Cited

U.S. PATENT DOCUMENTS

| | | | | |
|---|---|---|---|---|
| 3,100,721 A | | 8/1963 | Holden | |
| 4,927,432 A | | 5/1990 | Budinger et al. | |
| 5,177,908 A | | 1/1993 | Tuttle | |
| 5,212,910 A | | 5/1993 | Breivogel et al. | |
| 5,247,765 A | | 9/1993 | Quintana | |
| 5,287,663 A | | 2/1994 | Pierce et al. | |
| 5,394,655 A | | 3/1995 | Allen et al. | |
| 5,489,233 A | | 2/1996 | Cook et al. | |
| 5,533,923 A | | 7/1996 | Shamouilian et al. | |
| 5,554,064 A | | 9/1996 | Breivogel et al. | |
| 5,567,503 A | | 10/1996 | Sexton et al. | |
| 5,578,362 A | | 11/1996 | Reinhardt et al. | |
| 5,928,070 A | * | 7/1999 | Lux | 451/526 |
| 6,022,268 A | * | 2/2000 | Roberts et al. | 451/41 |
| 6,036,579 A | * | 3/2000 | Cook et al. | 451/36 |
| 6,062,968 A | | 5/2000 | Sevilla et al. | |
| 6,095,902 A | * | 8/2000 | Reinhardt | 451/120 |
| 6,099,394 A | | 8/2000 | James et al. | |
| 6,120,353 A | | 9/2000 | Suzuki et al. | |

* cited by examiner

*Primary Examiner*—Eileen P. Morgan
*Assistant Examiner*—Hadi Shakeri
(74) *Attorney, Agent, or Firm*—Gerald Kita; Kenneth Benson

(57) ABSTRACT

This invention describes improved polishing pads useful in the manufacture of semiconductor devices or the like. The pads of the present invention may have an advantageous hydrophilic polishing material and are sufficiently thin to generally improve predictability and polishing performance.

17 Claims, No Drawings

POLISHING PADS AND METHODS RELATING THERETO

This application is a continuation of application Ser. No. 09/488,414 filed Jan. 21, 2000, now U.S. Pat. No. 6,354,915, which claims the priority of Provisional Application No. 60/116,547 filed Jan. 21, 1999.

BACKGROUND OF THE INVENTION

1. Field of the Invention

The present invention relates generally to polishing pads useful in the manufacture of semiconductor devices, memory disks or the like. More particularly, the polishing pads of the present invention comprise a base substrate which supports a thin hydrophilic polishing layer, the polishing layer having an particular surface texture and topography.

2. Discussion of the Related Art

High precision chemical-mechanical polishing is often required in the manufacture of integrated circuits and memory disks. Such polishing is generally accomplished, using a polishing pad in combination with a polishing fluid. However, unwanted "pad to pad" variation in polishing performance is quite common, and therefore a need exists for polishing pads which exhibit more predicable performance.

U.S. Pat. No. 4,927,432 describes a polishing pad comprising a porous thermoplastic resin which is reinforced with a fibrous network such as a felted mat; the polishing material is modified by coalescing the resin among the fibers, preferably by heat treatment, to increase the porosity and hardness of the material as well as increasing the surface activity of the resin.

SUMMARY OF INVENTION

The present invention is directed to polishing pads having: 1. a base substrate; and 2. a thin hydrophilic polishing layer. The polishing layer has a particular surface texture and topography. "Texture" is intended to mean surface characteristics on a scale of less than 10 microns, and "surface topography" is intended to mean surface characteristics of 10 microns or more.

The base substrates of the present invention can comprise a single layer or multiple layers and can comprise a combination of layers that are bonded together. What is critical is that at least a portion of the base layer defines a planarity even when a non-uniform pressure of 10 pounds per square inch is applied against the base layer. In one embodiment, a base layer is bonded to a polishing layer and the combination is slid over a rigid component such as a platen or plate during polishing. A preferred base layer comprises a resilient layer of plastic, particularly an engineering plastic, such as a polyamide, polyimide, and/or polyester, particularly poly (ethylene terephthalate) or "PET". The layer is preferably a flexible web capable of being pulled from a roll or easily wound into a roll.

The base substrate of the present invention preferably has a thickness of less than 1 millimeter. In a preferred embodiment, the support layer has a thickness of less than 0.5 millimeters, more preferably less than 300 microns.

In a preferred embodiment, the thin polishing layers of the present invention are less than 500 microns, more preferably less than 300 microns and yet more preferably less than 150 microns and comprise a random surface texture comprising pores and/or micro voids of varying sizes and dimensions. A preferred method of forming the thin polishing layer is by coagulation of a polymer onto the support (base) layer, such as in accordance with the "Process For Producing Microporous Films and Coatings" described in U.S. Pat. No. 3,100,721 which is hereby incorporated into this specification by reference. In an alternative embodiment, the thin polishing layer is, printed, sprayed, cast, molded, ink-jet printed or otherwise coated onto the support layer and thereafter solidified by cooling or by a curing reaction.

It has been surprisingly discovered that the combination of a thin base layer and a thin polishing layer can provide ultra high performance polishing, due to a more precise and predictable polishing interaction when a rigid support presses the thin polishing pad against (and the pad is moved in relation to) a substrate to be polished. This polishing pad can be manufactured to very tight tolerances and (together with the rigid support) can provide predictable compressibility and planarization length. "Planarization length" is intended to mean the span across the surface of a polishing pad which lies substantially in a single plane and remains in a single plane during polishing, such that as high features on a wafer surface are polished, features of lesser height do not polish unless or until the higher features are diminished to the height of the shorter features.

It has been surprisingly discovered that polishing pads having a thickness greater than 1.5 millimeters have a much higher propensity for unpredictable warping or otherwise deviations from their original shape. Such warping and/or deviations are generally more detrimental to ultra precision polishing performance than pads having a thin base substrate in accordance with the present invention.

It has also been surprisingly discovered that thin polishing layers in accordance with the present invention are less susceptible to unpredictable polishing performance due to material fatigue during the polishing operation. For the polishing layers of the present invention, fatigue effects are much more predictable and generally have a diminished affect on polishing performance. Furthermore, thin polishing layers will tend to fully saturate and reach a steady state equilibrium with a polishing slurry much more quickly and predictably than conventional polishing pads.

In a preferred embodiment, the polishing layer is substantially free of macro-defects. "Macro-defects" are intended to mean burrs or other protrusions from the polishing surface of the pad which have a dimension (either width, height or length) of greater than 25 microns.

Macro-defects should not be confused with "micro-asperities." Micro-asperities are intended to mean burrs or other protrusions from the polishing surface of the pad which have a dimension (either width, height or length) of less than 10 microns. It has been surprisingly discovered that micro-asperities are generally advantageous in ultra precision polishing, particularly in the manufacture of semiconductor devices, and in a preferred embodiment, the polishing layer provides a large number of micro-asperities at the polishing interface.

Furthermore, the polishing layers of the present invention comprise a hydrophilic material. The polishing layer preferably has: i. a density greater than 0.5 g/cm$^3$; ii. a critical surface tension greater than or equal to 34 milliNewtons per meter; iii. a tensile modulus of 0.02 to 5 GigaPascals; iv. a ratio of tensile modulus at 30° C. to tensile modulus at 60° C. of 1.0 to 2.5; v. a hardness of 15 to 80 Shore D; vi. a yield stress of 300–6000 psi (2.1–41.4 MegaPascal); vii. a tensile strength of 1000 to 15,000 psi (7–105 MegaPascal); and viii. an elongation to break up to 500%. In a preferred embodiment, the polishing layer further comprises a plurality of soft domains and hard domains. Soft domains may possibly be a polymer. Hard domains may possibly be ceramic particles. Particles which may be incorporated into the polishing layer include: alumina, silicon carbide, chromia, alumina-zirconia, silica, diamond, iron oxide, ceria, boron nitride, boron carbide, garnet, zirconia, magnesium oxide, titania, and combinations thereof.

Pads of the present invention may be manufactured to be placed on a rigid platen such as the circular platen of a typical semiconductor planarization apparatus. They may also be manufactured for use in linear-type planarization apparatus in the form of a rolled web which can be indexed over a plate which provides rigid planarity for the pad during polishing. Another possible form for the pad is that of a continuous belt.

DETAILED DESCRIPTION OF THE PREFERRED EMBODIMENTS

The present invention is directed to an improved polishing pad useful in the polishing or planarizing of substrates, particularly substrates for the manufacture of semiconductor devices, memory disks or the like. The compositions and methods of the present invention may also be useful in other industries and can be applied to any one of a number of materials, including but not limited to silicon, silicon dioxide, metal (including, but not limited to tungsten, copper, and aluminum), dielectrics (including polymeric dielectrics), ceramics and glass.

The pads of the present invention comprise a polishing layer having an outer surface. Preferred processes for the manufacture of a polishing layer in accordance with the present invention include: 1. casting, 2. coalescing, 3. spraying, 4. molding, 5. printing (including ink-jet printing), or 6. any similar-type process in which a flowable material is positioned and solidified, thereby creating at least a portion of a pad's topography.

By flowing and solidifying at least a portion of the topography into (or onto) the pad polishing layer (without cutting) in accordance with the present invention, the polishing layer surface is far less disturbed or damaged (relative to machining); therefore the pads of the present invention will exhibit fewer macro-defects, and pad polishing performance and predictability of pad performance, are generally improved.

Pads are generally conditioned prior to use. The conditioning creates or augments the texture of the pad. During use, the texture can experience unwanted plastic flow and can be fouled by debris. As a result, pads are generally re-conditioned periodically during their useful life to regenerate an optimal micro-topography. In some embodiments, the polishing pads of the present invention require less re-conditioning during use, relative to conventional polishing pads.

In a preferred embodiment, the pad's macro-structure is incorporated into the surface of the polishing layer as an integral part of the manufacturing process. One possible way of doing this is to have present mold protrusions around which pad material initially flows and solidifies. In this way, the macro-topography can be simultaneously created along the polishing layer's outer surface as the pad material solidifies. The macro-topography preferably comprises one or more indentations having an average depth and/or width of greater than 0.1, more preferably 0.4 and yet more preferably 0.6 millimeters. This macro-topography facilitates the flow of polishing fluid and thereby enhances polishing performance.

In a preferred embodiment, the pad material is sufficiently hydrophilic to provide a critical surface tension greater than or equal to 4 milliNewtons per meter, more preferably greater than or equal to 37 and most preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic. Critical Surface Tension of common polymers are provided below:

| Polymer | Critical Surface Tension (mN/m) |
|---|---|
| Polytetrafluoroethylene | 19 |
| Polydimethylsiloxane | 24 |
| Silicone Rubber | 24 |
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |
| Nylon 6 | 42 |
| Polyurethane | 45 |
| Polycarbonate | 45 |

In one embodiment, the pad matrix is derived from at least:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether;
7. a urethane;
8. a polyacrylamide;
9. an ethylene/ester copolymer or an acid derivative thereof;
10. a polyvinyl alcohol;
11. a polymethyl methacrylate;
12. apolysulfone;
13. an polyamide;
14. a polycarbonate;
15. a polyvinyl chloride;
16. an epoxy;
17. a copolymer of the above; or
18. a combination thereof.

Preferred pad materials comprise urethane, carbonate, amide, sulfone, vinyl chloride, acrylate, methacrylate, vinyl alcohol, ester or acrylamide moieties. The pad material can be porous or non-porous. In one embodiment, the matrix is non-porous; in another embodiment, the matrix is non-porous and free of fiber reinforcement.

In a preferred embodiment, the polishing layer material comprises: 1. a plurality of rigid domains which resists plastic flow during polishing; and 2. a plurality of less rigid domains which are less resistant to plastic flow during polishing. This combination of properties provides a dual mechanism which has been found to be particularly advantageous in the polishing of silicon dioxide and metal. The hard domains tend to cause the protrusion to rigorously engage the polishing interface, whereas the soft domains tend to enhance polishing interaction between the protrusion and the substrate surface being polished.

The rigid phase size in any dimension (height, width or length) is preferably less than 100 microns, more preferably less than 50 microns, yet more preferably less than 25 microns and most preferably less than 10 microns. Similarly the non-rigid phase is also preferably less than 100 microns, more preferably less than 50 microns, more preferably less than 25 microns and most preferably less than 10 microns. Preferred dual phase materials include polyurethane polymers having a soft segment (which provides the nonrigid phase) and a hard segment (which provides the rigid phase). The domains are produced during the forming of the polishing layer by a phase separation, due to incompatibility between the two (hard and soft) polymer segments.

Other polymers having hard and soft segments could also be appropriate, including ethylene copolymers, copolyester, block copolymers, polysulfones copolymers and acrylic copolymers. Hard and soft domains within the pad material can also be created: 1. by hard and soft segments along a polymer backbone; 2. by crystalline regions and non-crystalline regions within the pad material; 3. by alloying a hard polymer with a soft polymer; or 4. by combining a polymer with an organic or inorganic filler. Useful such compositions include copolymers, polymer blends interpenetrating polymer networks and the like. application Ser. No. 09/049,864, now U.S. Pat. No. 6,099,394 which is made a part of this specification by reference, describes hard domains as possibly being ceramic particles, particularly an oxide, most particularly a metal oxide. Particles which may be incorporated into the polishing layer include: alumina, silicon carbide, chromia, alumina-zirconia, silica, diamond, iron oxide, ceria, boron nitride, boron carbide, garnet, zirconia, magnesium oxide, titania, and combinations thereof.

The preferred methods of creating the macro-channels or macro-indentations are embossing or printing. The macro-indentations are useful in providing large flow channels for the polishing fluid, during the polishing operation.

After forming the pad's polishing layer, including at least a part of the macro-topography, the outer surface can be further modified by adding a micro-topography. The micro-topography is preferably created by moving the polishing layer surface against the surface of an abrasive material. In one embodiment, the abrasive material is a rotating structure (the abrasive material can be round, square, rectangular, oblong or of any geometric configuration) having a plurality of rigid particles embedded (and preferably, permanently affixed) upon the surface. The movement of the rigid particles against the pad surface causes the pad surface to undergo plastic flow, fragmentation or a combination thereof (at the point of contact with the particles). The abrasive surface need not rotate against the pad surface; the abrasive surface can move against the pad in any one of a number of ways, including vibration, linear movement, random orbitals, rolling or the like.

The resulting plastic flow, fragmentation or combination thereof (due to the abrasive surface), creates a micro-topography upon the pad's outer surface. The micro-topography can comprise a micro-indentation with a micro-protrusion adjacent to at least one side. In one embodiment, the micro-protrusions provide at least 0.1 percent of the surface area of the pad's polishing surface, and the micro-indentations have an average depth of less than 50 microns, more preferably less than 10 microns, and the micro-protrusions have an average height of less than 50 microns and more preferably less than 10 microns. Preferably, such surface modification with an abrasive surface will cause minimal abrasion removal of the polishing layer, but rather merely plows furrows into the pad without causing a substantial amount, if any, of pad material to separate from the polishing layer. However, although less preferred, abrasion removal of pad material is acceptable, so long as a micro-topography is produced.

In an alternative embodiment, at least a portion of the micro-indentations or micro-protrusions may also be created during the manufacturing process by incorporation of appropriate features into the pad surface. Formation of micro-topography and macro-topography during the fabrication of the pad can diminish or even negate the necessity of pre-conditioning break-in. Such formation also provides more controlled and faithful replication of the micro-topography as compared to surface modification subsequent to pad creation.

application Ser. No. 09/129,301, which is made a part of the present specification by reference, describes the manufacture of pads by extrusion wherein the resulting pad sheet material may be formed into a polishing belt by creating a seam from the two ends of the sheet, or in an alternative, the sheet may be cut to form pads of any shape or size.

The pads of the present invention are preferably used in combination with a polishing fluid, such as a polishing slurry. During polishing, the polishing fluid is placed between the pad's polishing surface and the substrate to be polished. As the pad is moved relative to the substrate being polished, the micro-indentations allow for improved polishing fluid flow along the interface (between the pad and the substrate to be polished). The improved flow of polishing fluid generally allows for more efficient and effective polishing performance.

Since at least some of the macro-topography is not created by an external means (such as by machining), the macro-topography is less prone to macro-defects, such as burrs or protrusions. This has been found to improve polishing pad performance by providing a polishing surface having very low levels of macro-defects and by substantially diminishing debris trapped in the macro-indentations that would otherwise inhibit the flow of polishing fluid.

In use, the pad s of the present invention are preferably attached to a platen or slid over a rigid plate and then brought sufficiently proximate with a workpiece to be polished or planarized. Surface irregularities are removed at a rate which is dependent upon a number of parameters, including: pad pressure on the workpiece surface (or vice versa); the speed at which the pad and workpiece move in relation to one another; and the components of the polishing fluid.

As the pad polishes, the micro-topography can experience abrasion removal or plastic flow (the micro-protrusions are flattened or are otherwise less pronounced), which can diminish polishing performance. The micro-protrusions are then preferably re-formed with further conditioning, such as by moving the pad against an abrasive surface again and causing the material to once again form furrows. Such reconditioning is generally not as rigorous and/or not required as often for pads of the present invention, relative to may common prior art pads.

The preferred abrasive surface for conditioning is a disk which is preferably metal and which is preferably embedded with diamonds of a size in the range of 1 micron to 0.5 millimeters. During conditioning, the pressure between the conditioning disk and the polishing pad is preferably between 0.1 to about 25 pounds per square inch. The disk's speed of rotation is preferably in the range of 1 to 1000 revolutions per minute.

A preferred conditioning disk is a four inch diameter, 100 grit diamond disk, such as the RESI™ Disk manufactured by R. E. Science, Inc. Optimum conditioning was attained when the downforce was 10 lbs per square inch, platen speed was 75 rpm, the sweep profile was bell-shaped, the number of preconditioning break-in sweeps was 15 and the number of replenishing conditioning sweeps between wafers was 15.

Optionally, conditioning can be conducted in the presence of a conditioning fluid, preferably a water based fluid containing abrasive particles.

The polishing fluid is preferably water based and may or may not require the presence of abrasive particles, depending upon the composition of the polishing layer. For example, a polishing layer comprising abrasive particles may not require abrasive particles in the polishing fluid.

EXAMPLES

Example 1

This example demonstrates the ability to achieve good polishing performance with a thin pad used with a conventional slurry without the need for conditioning.

A sheet of 7 mil polyester film, precoated with an adhesion promoting coating, was spray coated with an aqueous based latex urethane (W242 from Witco) containing 2 wt. % (40 vol. %) of polymeric microballons (Expancel). Multiple coats were applied, with drying between each coat, to build up a layer of the required thickness (3 mils). After drying, the sheet surface was lightly sanded to remove high spots and to provide a suitable texture for polishing. Pressure sensitive adhesive was applied to the back of the sheet and a circular, 28 inch diameter pad was then die-cut from the sheet.

The pad was used to polish TEOS oxide films deposited on silicon wafers. Polishing was performed on a Strasbaugh 6DS-SP using a down-force of 9 psi, platen speed of 20 rpm and a carrier speed of 15 rpm. The slurry was ILD1300 from Rodel, used at a flow rate of 125 mil/min. No pad conditioning was done either during polishing or between wafers. A stable removal rate of 600 A/min with a non-uniformity of 10% was achieved.

Example 2

This example demonstrates the ability to incorporate the abrasive into the pad and polish with a non-abrasive containing reactive liquid.

A sheet of 7 mil polyester film, precoated with an adhesion promoting coating, was spray coated with an aqueous based latex urethane (W242 from Witco) containing 70 wt. % of slurry containing particles (SCP's). The SCP's comprised 95 wt % of ceria. Multiple coats were applied, with drying between each coat, to build up a layer of the required thickness (15 mils). Pressure sensitive adhesive was applied to the back of the sheet and a circular, 28 inch diameter pad was then die-cut from the sheet.

The pad was used to polish TEOS oxide films deposited on silicon wafers. Polishing was performed on a Strasbaugh 6DS-SP using a down-force of 6 psi, platen speed of 65 rpm and a carrier speed of 50 rpm. The liquid used during polishing was pH 10.5 ammonium hydroxide solution at a flow rate of 100 mil/min. The pad was preconditioned prior to polishing to remove high spots and concurrently conditioned during polishing using a 100 grit conditioning disk. A stable removal rate of 1500 A/min was achieved, by moving the polishing surface and the surface being polished relative to and biased toward one another as the fluid was maintained between the surfaces, the fluid preventing at least 50% of the surfaces, on average, from touching one another.

Generally, a method of polishing a substrate surface on a substrate by the polishing surface of a polishing layer of this invention comprises biasing the surfaces together by applying a uniform force of less than 25 pounds per square inch and compressing the polishing surface, preferably, but not always by less than 5 microns, thereby causing the polishing surface to exhibit a planar configuration which is parallel to a major portion of the substrate surface, the polishing surface comprising a pluralities of nanoasperities.

Nothing from the above discussion is intended to be a limitation of any kind with respect to the present invention. All limitations to the present invention are intended to be found only in the claims, as provided below.

What is claimed is:

1. A method of polishing a surface of a substrate useful in the manufacture of a semiconductor device, comprising:

placing a fluid between the substrate and a thin pad, the thin pad having a polishing layer, the polishing layer further comprising a polishing surface;

moving the polishing surface and the substrate surface relative to and biased toward one another as the fluid or additional fluid is maintained between the surfaces, the fluid preventing at least 50% of the surfaces, on average, from touching one another;

biasing the surfaces together by applying a uniform force of less than 25 pounds per square inch and compressing the polishing surface, thereby causing the polishing surface to exhibit a planar configuration which is parallel to a major portion of the substrate surface, said polishing surface comprising a plurality of nanoasperities;

said polishing layer having a thickness of less than or equal to one millimeter, the polishing layer being bonded to a support film, the support film having a thickness of less than or equal to 1 millimeter, said thin pad having an average total thickness of less than or equal to three millimeters, said polishing surface consisting essentially of a polishing material having:

i. a hardness of 15 to 80 Shore D;

ii. a yield stress of 300–6000 psi;

iii. a tensile strength of 1000 to 15,000 psi; and iv. an elongation to break less than or equal to 500%, said polishing material comprising at least one moiety from a group consisting of: 1. a urethane; 2. a carbonate; 3. an amide; 4. an ester; 5. an ether; 6. an acrylate; 7. a methacrylate; 8. an acrylic acid; 9. a methacrylic acid; 10. a sulphone; 11. an acrylamide; 12. a halide; 13. an imide; 14. a carboxyl; 15. a carbonyl; 16. an amino; 17. an aldehydric and 18. a hydroxyl.

2. The method in accordance with claim 1 wherein macro-topography is incorporated into the polishing surface due to: i. embossing; ii. molding; iii. printing; iv. casting; v. sintering; vi. photo-imaging; vii. chemical etching; or viii. ink-jet printing.

3. The method in accordance with claim 2, whereby said polishing surface is formed by ink-jet printing.

4. The method in accordance with claim 1, wherein said polishing surface has, on average, less than 2 observable macro-defects per square millimeter of polishing surface when viewed at a magnification of 1000×.

5. The method in accordance with claim 1, wherein the polishing material further comprises a plurality of soft domains and a plurality of hard domains, the hard domains and soft domains having an average size of less than 100 microns.

6. The method in accordance with claim 5, wherein the hard domains and the soft domains are produced by a phase separation as the polishing layer is formed, the polishing layer comprising a polymer having a plurality of hard segments and a plurality of soft segments.

7. The method in accordance with claim 3, wherein the polishing layer consists essentially of a two phase polyurethane.

8. The method in accordance with claim 1, wherein the polishing layer is formed as a sheet by an extrusion process.

9. The method in accordance with claim 8, wherein said sheet has a beginning edge and ending edge, the edges being joined to form a continuous belt.

10. The method in accordance with claim 8, wherein said sheet is cut to form pads of any size or shape.

11. The method in accordance with claim 1 further comprising an insert around which a flowable material is solidified.

12. The method in accordance with claim 1, wherein the pad has an average aspect ratio of at least 400.

13. The method in accordance with claim 1, wherein the polishing layer further comprises abrasive particles.

14. A method of planarizing a silicon, silicon dioxide or metal substrate, comprising:

a) providing a polishing pad having a polishing layer, said polishing layer consisting essentially of a hydrophilic polishing layer, said polishing layer having a thickness of less than or equal to one millimeter and having a polishing surface consisting essentially of a polishing material having:

i. a selected critical surface tension providing the polishing pad with a corresponding hydrophilicity;

ii. a hardness of 15 to 80 Shore D;

iii. a yield stress of 300–6000 psi;

iv. a tensile strength of 1000 to 15,000 psi; and v. an elongation to break less than or equal to 500%, said polishing material comprising at least one moiety from a group consisting of: a urethane produced by a catalyst which accelerates an isocyanate reaction, said catalyst being devoid of copper, tungsten, iron or chromium; a carbonate; an amide; an ester; an ether; an acrylate; a methacrylate; an acrylic acid; a methacrylic acid; a sulphone; an acrylamide; a halide; and a hydroxide, said polishing surface having a macro-topography produced by solidifying a flowable material, and b) chemical mechanical polishing a metal, silicon or silicon dioxide substrate with said polishing pad.

15. The method in accordance with claim 14, wherein said macro-topography is incorporated into the polishing surface due to: i. embossing; ii. molding; iii. printing; iv. casting; v. sintering; vi. photo-imaging; vii. chemical etching; or viii. ink-jet printing.

16. The method in accordance with claim 14, wherein the polishing surface is conditioned to create a plurality of micro-asperities by moving an abrasive medium against the polishing surface, said abrasive medium carrying a plurality of rigid particles.

17. The method in accordance with claim 1, wherein the polishing layer consists essentially of a material selected from the group consisting of: polymethyl methacrylate, polyvinyl chloride, polysulfone, nylon, polycarbonate, polyurethane, ethylene copolymer, polyether sulfone polyether imide, polyethylene imine, polyketone and combinations thereof.

* * * * *